United States Patent [19]

Reddy et al.

[11] Patent Number: 4,583,466

[45] Date of Patent: Apr. 22, 1986

[54] STEP LIFT FOR RAILWAY CARS

[75] Inventors: Redreddy S. Reddy, Skokie, Ill.; Toussaint Filoni, Laval, Canada; Kenneth S. Fletcher, Dollard des Ormeau, Canada; Gad J. Shaanan, Montreal, Canada; Anthony J. Walsh, Lachine, Canada

[73] Assignee: Vapor Corporation, Chicago, Ill.

[21] Appl. No.: 440,091

[22] Filed: Nov. 8, 1982

[51] Int. Cl.[4] ..... B61D 23/02

[52] U.S. Cl. ..... 105/447; 105/443; 182/77; 414/545; 414/921

[58] Field of Search ..... 105/425, 436, 443, 444, 105/445, 446, 447, 448, 449, 430; 182/77 R, 96; 244/129.6; 414/545, 607, 921, 540

[56] References Cited

U.S. PATENT DOCUMENTS

| | | | |
|---|---|---|---|
| 461,156 | 10/1891 | Barber | 105/447 X |
| 653,769 | 7/1900 | Fuller | 105/447 X |
| 953,733 | 8/1910 | Allfree et al. | 105/449 |
| 1,168,464 | 1/1916 | Beck | 280/166 X |
| 1,628,505 | 5/1927 | Lundquist | 105/448 |
| 3,403,926 | 10/1968 | Way et al. | 105/444 X |
| 3,913,497 | 10/1975 | Maroshick | 105/447 |
| 4,081,091 | 3/1978 | Thorley | 414/545 |
| 4,168,134 | 9/1979 | Pohl | 105/445 X |
| 4,168,764 | 9/1979 | Walters | 182/96 X |
| 4,176,999 | 12/1979 | Thorley | 105/447 X |
| 4,180,366 | 12/1979 | Roth et al. | 414/921 X |
| 4,251,179 | 2/1981 | Thorley | 414/545 |
| 4,252,491 | 2/1981 | Hock | 414/921 X |
| 4,369,984 | 1/1983 | Hagen | 105/445 |

*Primary Examiner*—Robert B. Reeves
*Assistant Examiner*—Donald T. Hajec
*Attorney, Agent, or Firm*—Francis J. Lidd

[57] ABSTRACT

Apparatus for railway cars to handle the ingress and egress of passengers through a door opening where the apparatus selectively provides at the exterior of the car at the door opening an adjustable height platform, steps or a ground-to-car floor platform lift. The apparatus is storable within the railway car and extendable exteriorly of the railway car where it can then be selectively conditioned for a desired passenger handling mode as a platform positioned at a desired height between the car floor and ground, a series of steps extending between the car floor and ground, or a platform lift movable between ground level and car floor level.

12 Claims, 13 Drawing Figures

FIG. 7
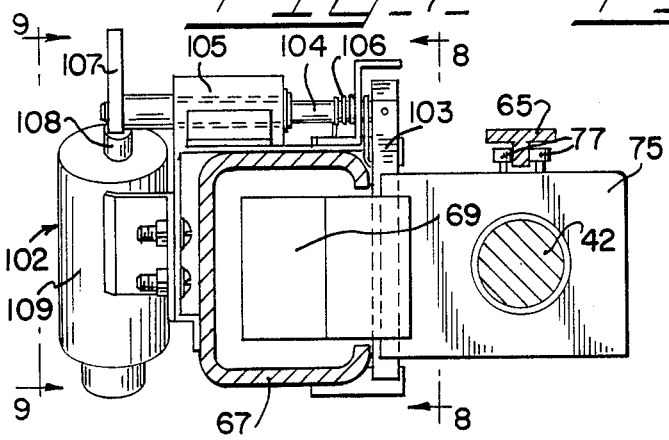
FIG. 6
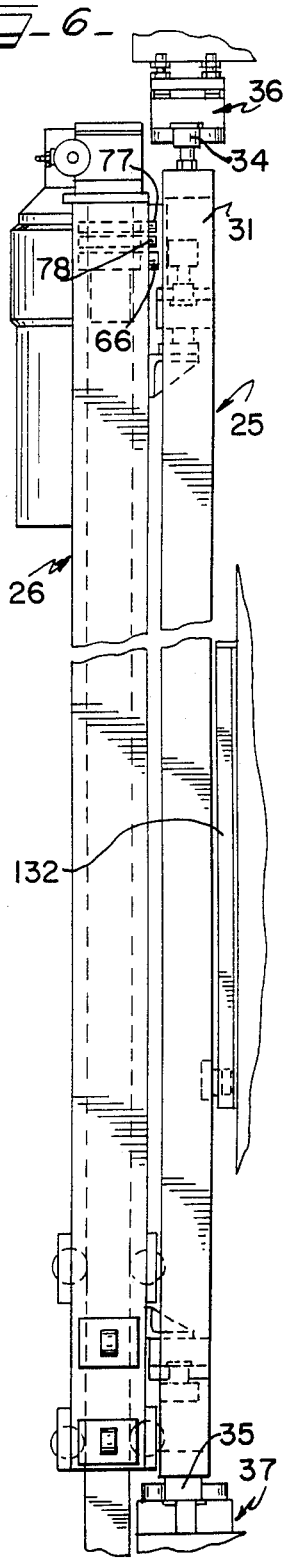
FIG. 8
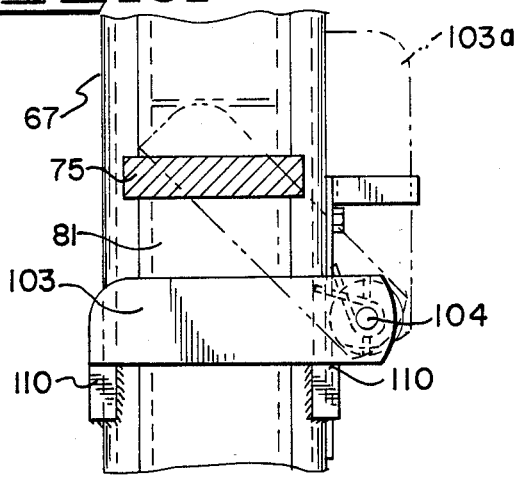
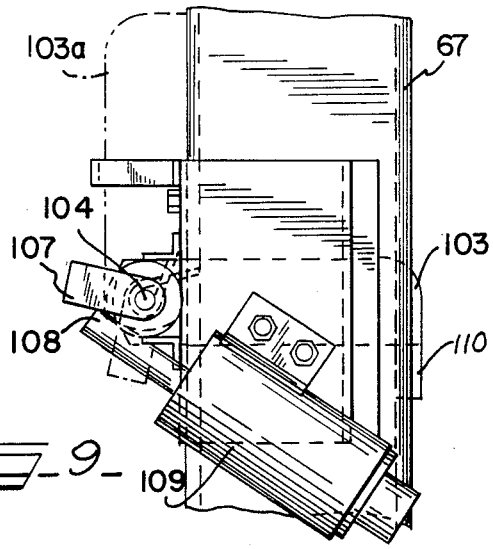
FIG. 9

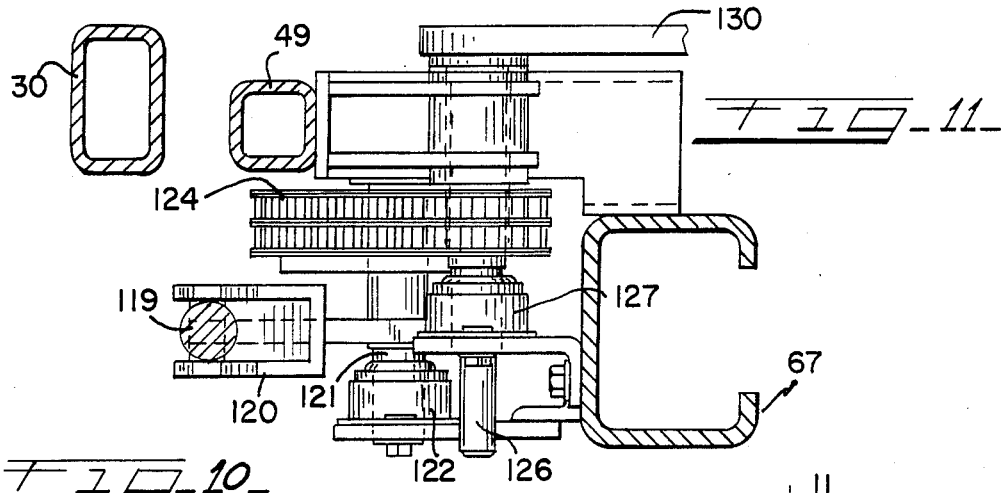
FIG. 11
FIG. 10
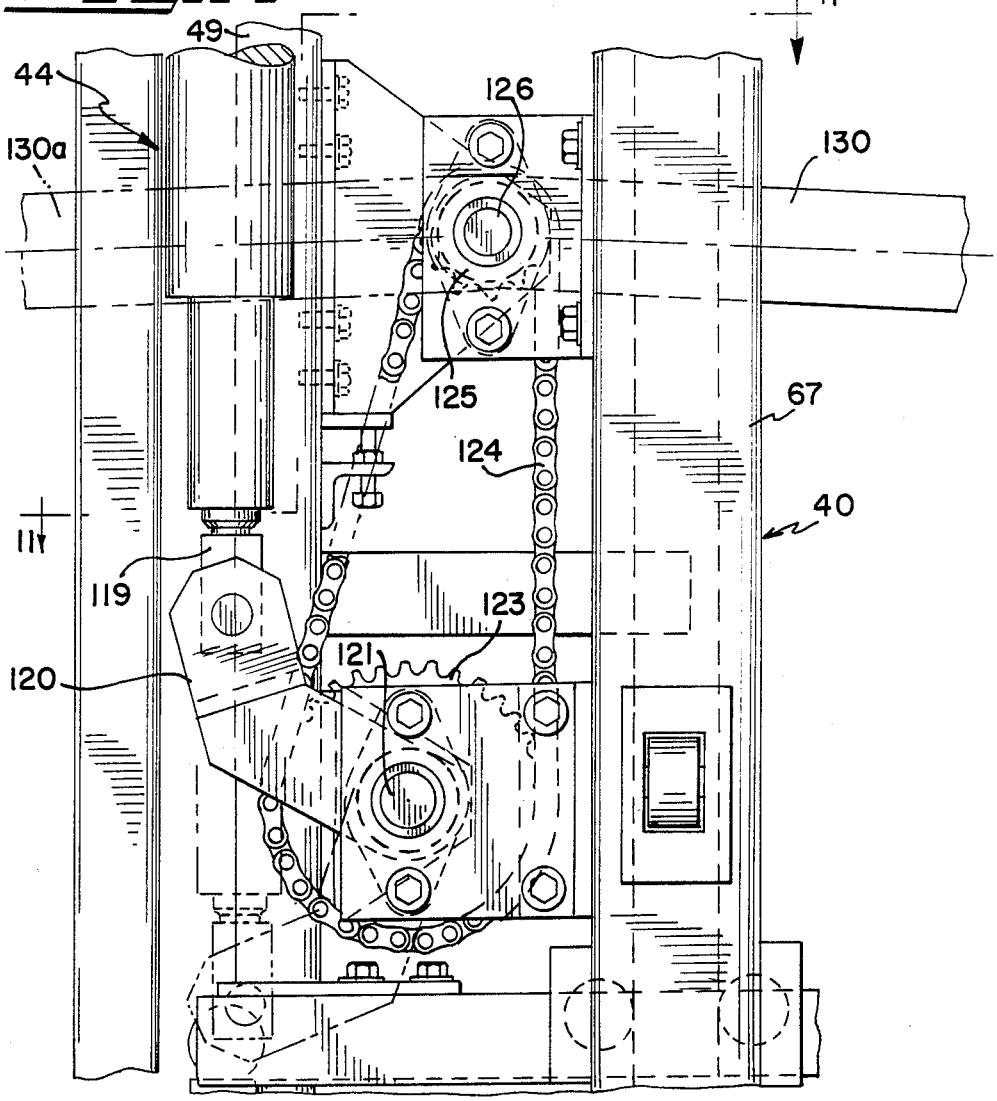

STEP LIFT FOR RAILWAY CARS

DESCRIPTION

This invention relates in general to an apparatus for handling the ingress and egress of passengers for a railway car at a door opening of the car, and more particularly to such an apparatus that is movable between a stored position within the car and a usable position outside of the car, and still more particularly to an apparatus that is capable of functioning to provide an adjustable height platform, a stairs, or a platform lift movable between ground and car floor levels. While the apparatus of the invention is particularly useful for railway cars, it should be appreciated that it can also be used for other vehicles where there is a need for providing an ingress and egress for people, especially where the floor of the vehicle is situated at such a distance above the ground that it is not practical to directly load passengers into the vehicle without the assistance of an apparatus which will bridge the distance from the ground to the car floor level.

Heretofore, it has been well known to provide various types of foldable steps or stairs to assist the passengers' movement from ground level to a vehicle floor level of some height above the ground level, such as illustrated in U.S. Pat. Nos. 461,156; 953,733; 1,168,464; 1,628,505; 3,913,497; 3,957,284 and 4,168,764. Some of the apparatuses disclosed also are capable of selectively being formed into a series of steps or a platform. It is also well known to provide for vehicles a platform lift which might be positioned at an adjustable height between a vehicle floor and the ground or used to lift an object from the ground level to the vehicle floor level. Such a device is commonly used for loading and unloading wheelchaired persons from vans.

There has been a need, particularly in the railway car industry, to provide a passenger handling apparatus in connection with the ingress and egress of passengers at a door opening which is capable of multimode operation where the apparatus may function as steps or stairs, as an adjustable height platform, or as a platform lift, and yet be storable within the vehicle when not needed. Such an apparatus is not known in the prior art, and it is therefore an object of the present invention to provide such an apparatus.

The present invention includes a frame which is movable between a stored position within a railway car at a door opening and a usable position exterior of the car. A step platform assembly is supported by the frame and likewise is capable of being adjusted so that it can be moved with the frame from a stored position within the car to a usable position outside of the car. In the usable position outside of the car, the step platform assembly is found capable of being conditioned to take the form of steps arranged between ground level and car floor level or a platform that may be adjustable between ground level and floor level or as a platform lift capable of moving between ground level and floor level to move passengers between those levels as needed. It should be readily appreciated that as a platform lift, it can accomodate other objects or a passenger in a wheelchair.

It is a principal object of the invention to provide a new and improved apparatus for handling the ingress and egress of passengers for a railway car.

It is a further object of the invention to provide a new and improved passenger handling apparatus capable of being used with a railway car between a stored position within the car and a usable position outside of the car and for plural modes of operation to accomodate the handling of passengers.

A further object of the invention resides in the provision of a passenger handling apparatus capable of being selectively used as an adjustable height platform, a step or stairs, or as a ground-to-car-level platform lift.

A still further object of this invention is in the provision of a passenger handling apparatus for railway cars to handle the ingress and egress of passengers through a door opening where the apparatus may selectively be stored within the vehicle or used outside of the vehicle and when used outside of the vehicle to be operated in an adjustable height platform, step entry, or platform lift modes.

A still further object of the invention is to provide an efficient and economically manufactured passenger handling apparatus for a railway car which may be retrofitted for existing cars or built into newly manufactured cars.

Another object of the present invention is to provide a multimode passenger handling apparatus for railway cars that is safe and easy to operate and where the safety of passengers is assured.

Other objects, features and advantages of the invention will be apparent from the following detailed disclosure, taken in conjunction with the accompanying sheets of drawings, wherein like reference numerals refer to like parts, in which;

FIG. 6 is a vertical broken view showing in elevation the apparatus looking from the end as taken substantially along lines 6—6 of FIG. 5;

FIG. 7 is an enlarged detailed transverse sectional view taken substantially along line 7—7 of FIG. 5 and illustrating the steps solenoid mechanism;

FIG. 8 is a detailed elevational view of the steps solenoid mechanism taken substantially along line 8—8 of FIG. 7 and looking at it from one side;

FIG. 9 is a vertical elevational view of the mechanism looking at it from the other side and taken substantially along line 9—9 of FIG. 7;

FIG. 10 is a greatly enlarged fragmentary side elevational view of the actuator or operator for driving the apparatus between the stored position within the car and the operating position outside of the car and illustrating in solid lines the position of the operator when it is outside of the car and in phantom when it is inside of the car in stored position;

FIG. 11 is a transverse sectional view taken substantially along line 11—11 of FIG. 10;

The passenger handling apparatus of the present invention is especially useful for railway cars and will be described in connection with a typical railway car although it is to be appreciated that it is to be used with other vehicles. Moreover, the apparatus could be installed as original equipment on a railway car or retrofitted in existing railway cars.

Figure 1:
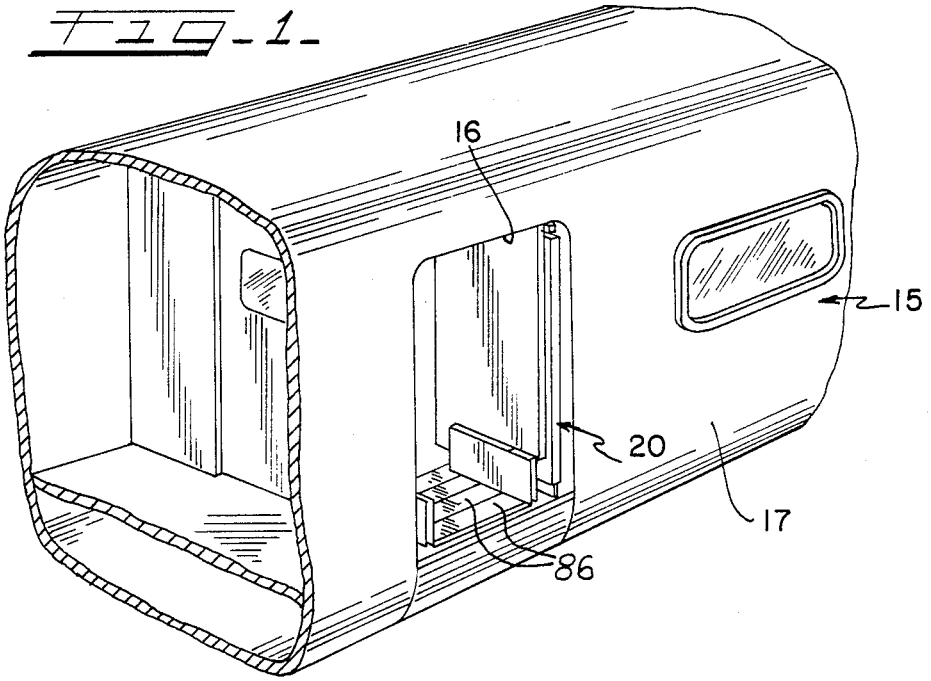
FIG. 1 is a fragmentary perspective view of a railway car having the door opening and passenger handling apparatus of the present invention where the apparatus is illustrated as being in the stored position within the car.
Figure 2:
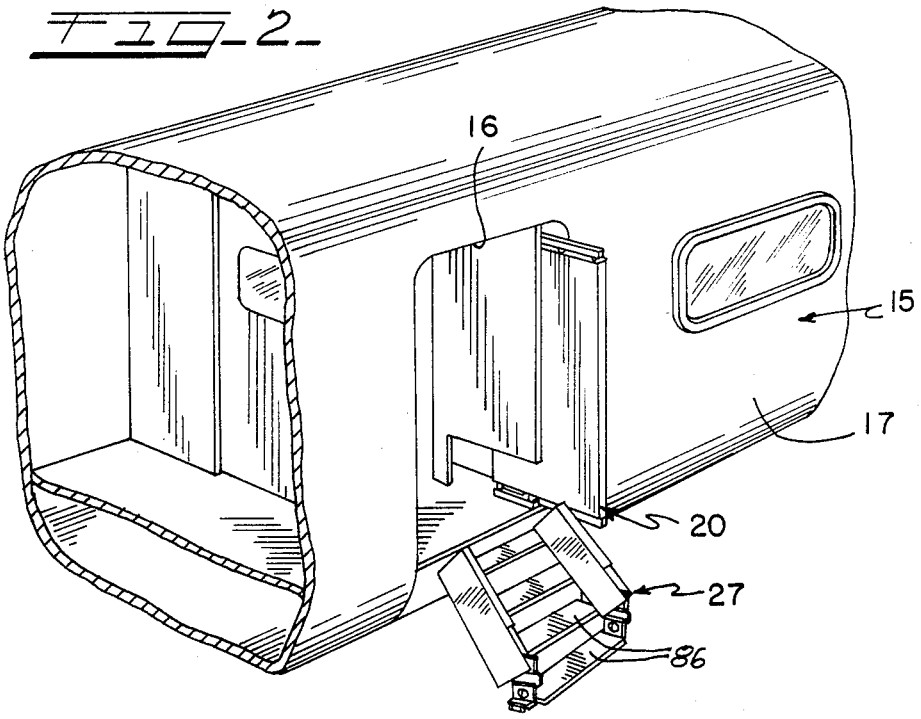
FIG. 2 is a view similar to FIG. 1 but illustrating the passenger handling apparatus of the present invention in use and particularly where it is conditioned for the step or stair mode to allow passengers to enter and exit the doorway from the ground level to the car floor level.

Referring now to the drawings and particularly to FIGS. 1 and 2, a railway car 15 is shown having a door opening 16 in a side wall 17 of the car for handling the ingress and egress of passengers. Although the doors for the opening are not illustrated, it will be appreciated that the door opening may be provided with one or more conventional doors operable between open and closed position by conventional door operating devices. Since the doors and the door operating devices form no part of the invention, they are not illustrated.

The passenger handling apparatus of the present invention is generally designated by the numeral 20 and is illustrated in FIG. 1 in the retracted and stored position within the car 15 and in FIG. 2 in extended position and out of the car and in the step or step entry or stairs mode where the steps provide passengers the opportunity to enter the car from ground level or exit the car to ground level. The passenger handling apparatus is also operable in an adjustable height platform or ground-to-car-floor platform lift mode, as will be more clearly explained hereafter. Particularly, it may be noted in FIG. 3 that the step platform assembly is in the platform mode which then may either be an adjustable height platform or be movable from the ground to the floor level of the car. Thus, the apparatus may be selectably operable in any one of three different modes.

Figure 3:
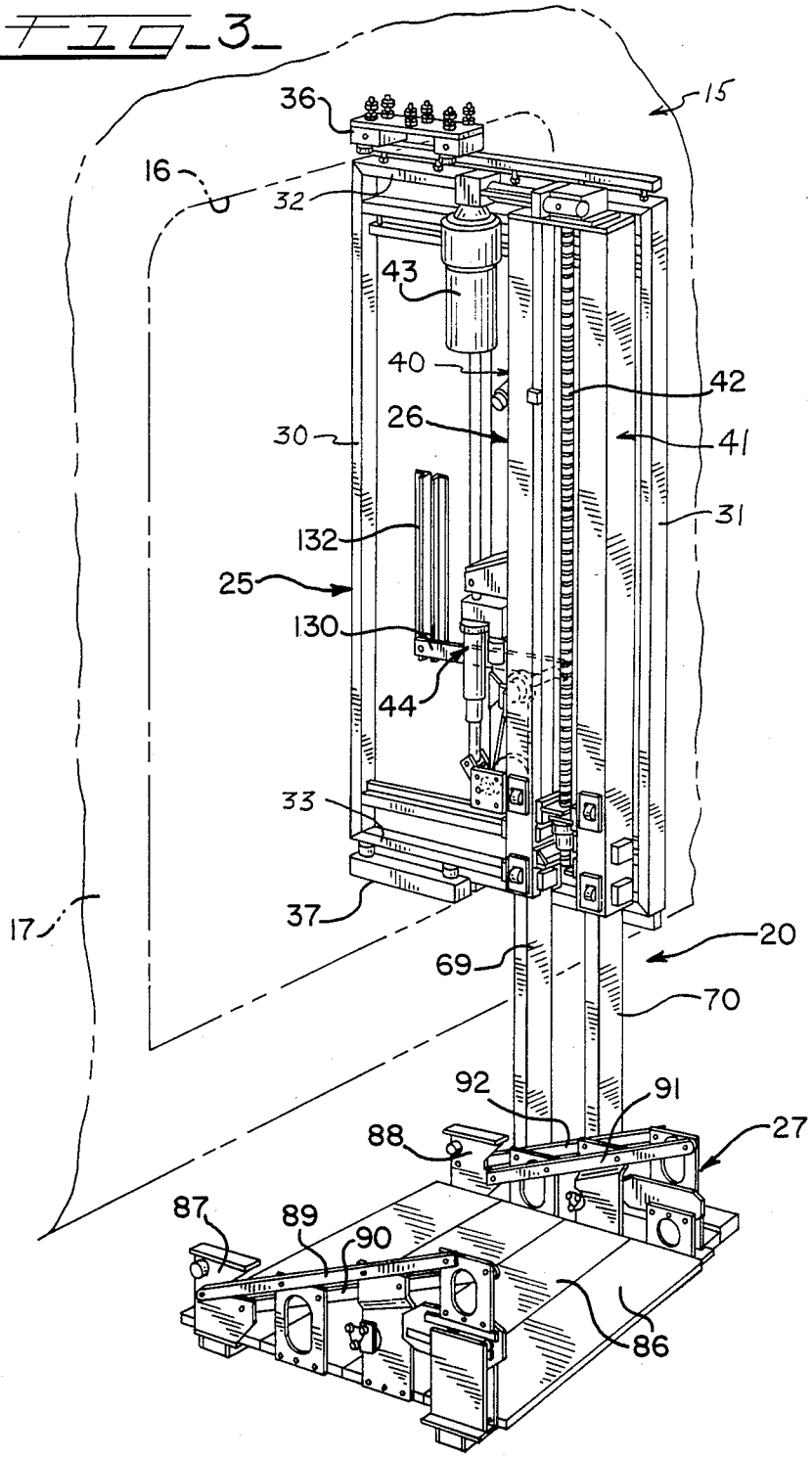
FIG. 3 is a greatly enlarged view of the passenger handling apparatus of the present invention with some parts broken away for purposes of clarity and illustrating the step platform assembly conditioned as a platform which may be adjustably positioned between the ground and car floor or be operated as a passenger lift between the ground and car floor.
Figure 4:
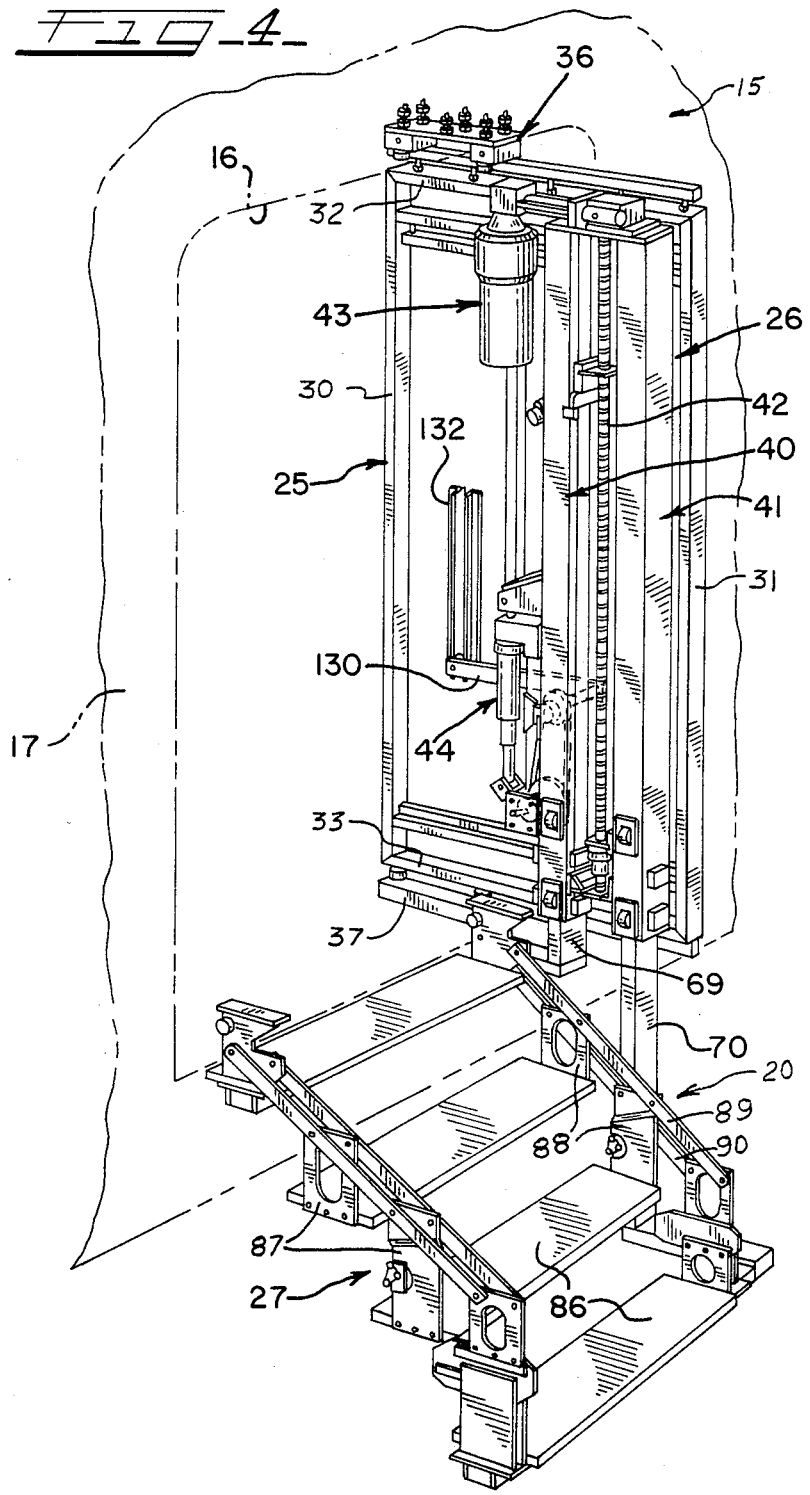
FIG. 4 is a view similar to FIG. 3 except that it illustrates the step platform assembly conditioned to be in the step or stair mode.

The passenger handling apparatus 20 includes generally a main or primary frame 25, a secondary or subframe 26 supported on the main frame and a step platform assembly 27 supported from the secondary frame. The main or primary frame extends vertically and is movable from the stored position within the car to the operating position out of the car as illustrated in FIGS. 3 and 4. The secondary or subframe assembly 26 is movable along the main frame assembly 25 from the positions shown in FIGS. 3 and 4 to a retracted position that is not illustrated but which would be at the opposite side of the main frame from that illustrated in FIGS. 3 and 4 when the entire apparatus is stored within the car. The step platform assembly is supported by the secondary frame assembly and when within the car rests on the car floor. As the apparatus is conditioned to be moved outward of the car and door operating position, the step platform assembly is raised slightly so that the entire apparatus can be driven outside of the car without interference with the car floor. Once in position outside of the car, the step platform assembly is conditioned to be used in one of the three modes earlier described. Accordingly, the main frame 25 extends vertically and perpendicular to the longitudinal axis of the car and is movable between a first position which is within the car and where it is stored and a second position which is extendable from the car when it is being used to support the step platform assembly in any of the modes of operation. In the stored position within the car, the door or doors of the car would then be closable to close the door opening 16.

Figure 5:
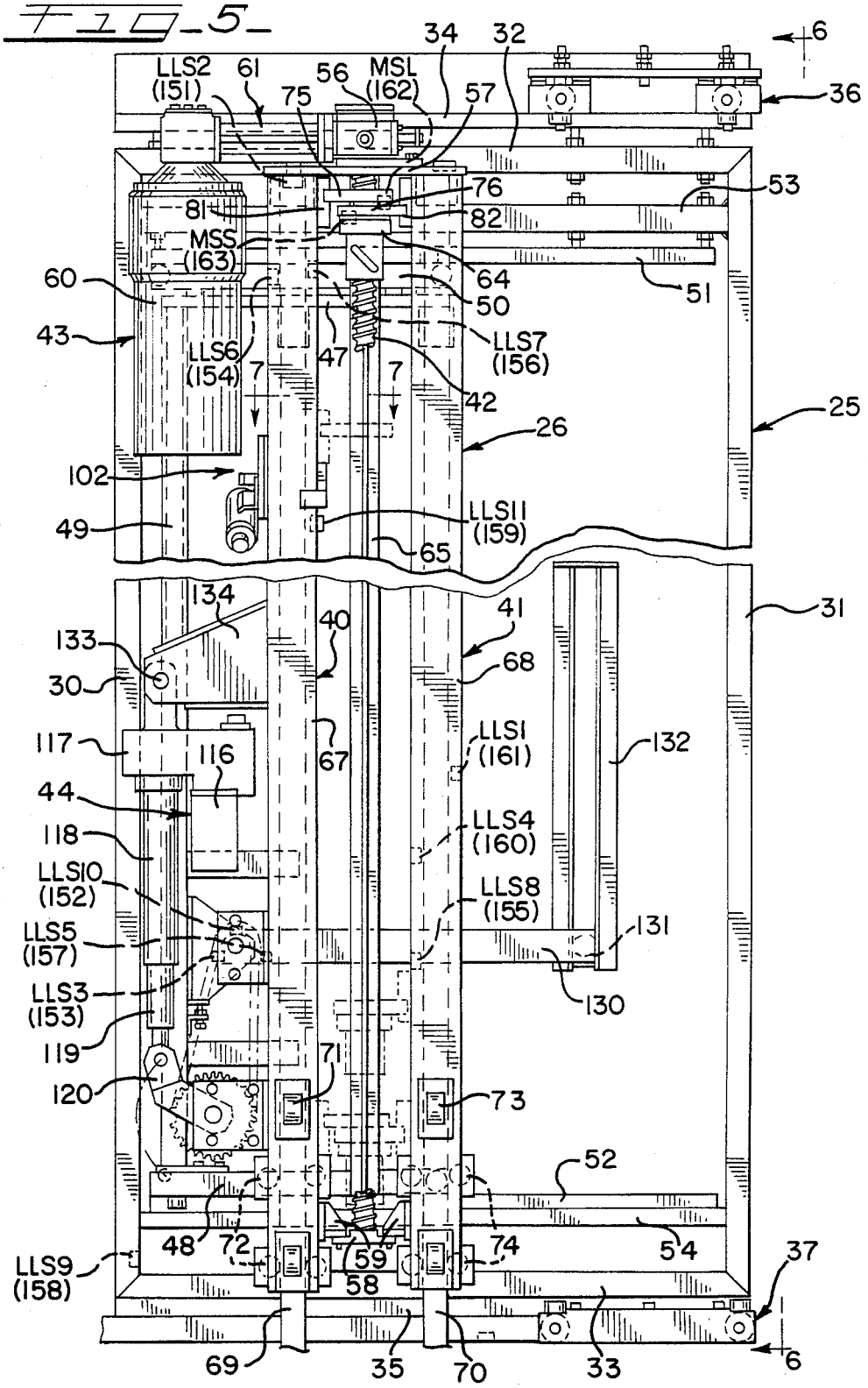
FIG. 5 is a broken side elevational view of the passenger handling apparatus where the step platform assembly is illustrated in the platform mode and where the apparatus is positioned outside of the car and where it also illustrates in phantom the positions of the vertical support bars when the apparatus is in the stairs mode.

The main or primary frame 25, as seen particularly in FIGS. 3, 4 and 5, is box-shaped and generally includes opposed upright frame members or bars 30 and 31 interconnected at their upper and lower rends by opposed upper and lower bars 32 and 33. Integral with or suitably secured to the upper and lower horizontal frame members 32 and 33 are upper and lower slide bars 34 and 35 which are slidably received in upper and lower track members 36 and 37 that are suitably mounted to the frame of the car and inside the door opening 16. The track members 36 and 37 include rollers engaging the opposite side faces of the slide bars as well as the end faces to provide adequate support and guidance for the apparatus. Thus, the track members allow the main frame to be slidably supported on the car frame between retracted and extended positions.

The secondary frame 26 includes generally a pair of vertically arranged slide bar assemblies 40 and 41, a vertically arranged threaded shaft 42, a vertical actuator 43, and a horizontal actuator 44. The step platform assembly 27 is supported by the vertical slide bar assemblies 40 and 41 and driven vertically by the vertical actuator 43 through the threaded shaft 42. The secondary frame assembly 26 is horizontally driven within the primary frame assembly 25 by the horizontal actuator 44, and the primary frame assembly 25 is also driven between its stored position within the car and its extended position outside the car by means of the horizontal actuator 44. The vertical slide bar assemblies 40 and 41 are interconnected at their upper end by a cross bar 47 and at their lower end by the lower roller housing 48. A vertical bracing bar 49 extends between the horizontal cross bar 47 and the lower roller housing 48. An upper roller housing 50 is secured to the cross bar 47. The upper roller housing 50 and the lower roller housing 48 coact with upper slide rail 51 and lower slide rail 52 in order to slidably mount the secondary frame assembly 26 relative to the main assembly 25. The upper and lower slide rails 51 and 52 are respectively connected to supporting cross arms 53 and 54 which are secured between the opposing side frame members 30 and 31 of the main frame assembly. Each of the roller housings 48 and 50 includes roller members which engage the front and back faces as well as the edge faces of the slide rails 51 and 52. It therefore can be appreciated that the secondary frame assembly 26 is slidably mounted on the main frame assembly and can move between the positions shown in FIG. 5 and a position at the opposite side of the main frame assembly. The position shown in FIG. 5 is that where the apparatus is extended from the car, and when the apparatus is in stored position, the assembly 26 will be positioned at the right-hand side of the main frame assembly 25.

The vertical threaded shaft 42 is rotatably mounted at its upper end in a bearing housing 56 carried on a cross plate 57 secured to the upper ends of the vertical slide bar assemblies 40 and 41 and at its lower end in a trunnion 58 mounted on a pair of brackets 59 that are in turn secured to the opposing faces of the slide bar assemblies 40 and 41. A reversible electric motor 60 suitably mounted on the secondary frame assembly drives the threaded shaft 42 through a suitable gear and drive box mechanism 61. Rotation of the threaded shaft 42 drives a ball nut assembly 64 vertically along the shaft depending upon the directional rotation of the shaft, which ball nut in turn raises and lowers the vertical drive bar assemblies, as will be explained below. Thus, the motor 60, drive box mechanism 61, threaded shaft 42 and ball nut 64 constitute a vertical actuator. In order to keep the ball nut from rotating during its movement along the threaded shaft, a vertically arranged T-bar 65 is suitably mounted on the secondary frame at upper and lower ends and provides a track for rollers 66 extending from the backside of the ball nut 64. Although horizontal and vertical actuators are shown to obtain the horizontal movement of the frame assembly and vertical movement of the step platform assembly, it should be appreciated that a single actuator of a type that could provide both horizontal and vertical drive functions could be used in place of two actuators.

The vertical slide bar assemblies 40 and 41 include respectivley vertically extending channel-shaped members 67 and 68 within which are slidably received vertical slide or support bars 69 and 70 to which the stair platform assembly 27 are secured. The vertical slide bars 69 and 70 are roller mounted withn the channel members 67 and 68 by means of a plurality of rollers 71 and 72 for the channel 67 and rollers 73 and 74 for the channel 68. The rollers are mounted on all four sides of the channel members in order to give proper support to the vertical slide bars 69 and 70. Secured to the upper ends of the vertical slide bars 69 and 70 are pick-up plates 75 and 76 respectivley for the vertical slide bars 69 and 70. The rectangular channel members 67 and 68 are slotted at their facing sides as particularly seen in FIG. 7 with respect to channel member 67 in order to allow the pick-up plates to extend from the vertical slide bars inwardly and in association with the threaded shaft 42. Each of the pick-up plates has a central opening therethrough through which the threaded shaft 42 extends. Additionally, each of the pick-up plates 75 and 76 has guide rollers 77 and 78 respectively for pick-up plates 75 and 76 which extend rearwardly from the plates and into roller engagement with the T-bar, as seen particularly in FIG. 7. The pick-up plate 76 rides on top of the ball nut 64, while the pick-up plate 77 rides on top of the pick-up plate 76. The pick-up plates are respectively mounted on extensions 81 and 82 which are in turn mounted directly to the vertical slide bars 69 and 70. Accordingly, downward movement of the ball nut 64 along the shaft 42 will also allow the pick-up plates 75 and 76 to follow and permit downward movement of the vertical slide bars 69 and 70. Likewise, upward movement of the ball nut assembly will drive the pick-up plates upwardly and also the vertical slide bars upwardly. Moreover, it will be appreciated that since the step platform assembly is connected to the slide bars, it will move up and down with the pick-up plates.

Figure 12:
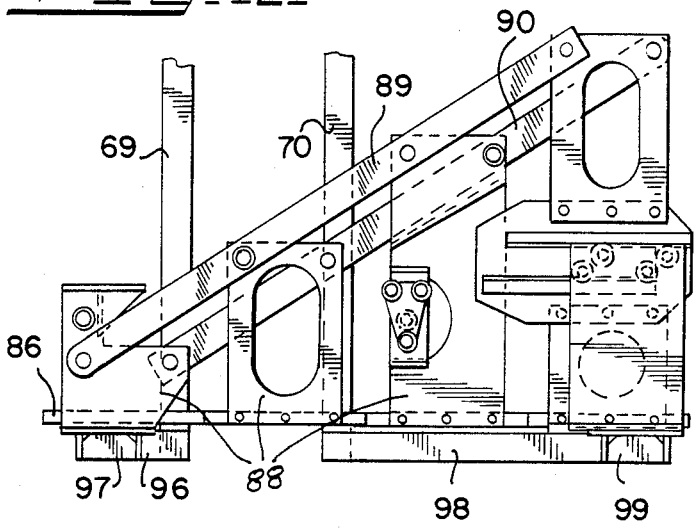
FIG. 12 is a fragmentary side elevational view of the step platform mechanism supported by the vertical support bars and showing the mechanism in the platform mode.
Figure 13:
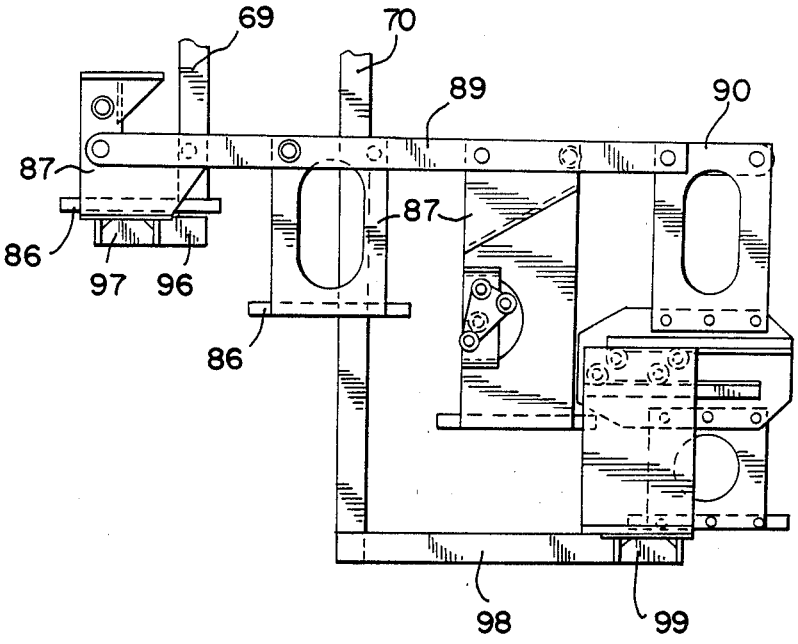
FIG. 13 is a view similar to FIG. 12 but showing the step platform mechanism in the step or stairs mode.

The step platform assembly 27 includes a plurality of plates 86 which, when arranged in edge-to-edge and coplanar relation as shown in FIGS. 3 and 12, form a platform, and which, when arranged in spaced apart relation as shown in FIGS. 4 and 13, form a step or stair configuration. The plates 86 are interconnected by a parallelogram linkage which maintains them in parallel relation with respect to each other at all times. The parallelogram linkage includes brackets 87 and 88 maintained at opposite ends of the plates 86 and extending upwardly at right angles thereto. The brackets are of varying heights and are interconnected together by parallelogram links 89 and 90 on one side and 91 and 92 on the other side. The links are pivotally connected to each of the brackets such that movement of one of the plates 86 relative to another causes the plates to be maintained in parallel relation to each other at all times.

The first plate or step 86 is connected to vertical slide bar 69, while the last plate or step is connected to the vertical slide bar 70. The vertical slide bar 69 includes at its lower end a short rearward extension 96 to which is connected a lateral support bar 97 that is received in a channel formed beneath the first plate 86. Similarly, the vertical slide bar 70 includes an extension 98 of substantially greater length than the extension 96 which extends forwardly and has secured at the end thereof a laterally extending support bar 99 that is received in a channel formed beneath the outermost or last plate or step 86. Accordingly, relative movement between the vertical slide bar 69 and 70 will cause the step platform assembly to move from a platform configuration to a step or stair configuration and likewise from a step or stair configuration to a platform configuration.

When the apparatus is desired to be used in the platform mode, it is conditioned so that both of the vertical slide bars 69 and 70 which support the platform assembly move together up or down. Likewise, when it is desired that the apparatus be used in the step or stair mode, it is operated such that the vertical slide bar 69 which is secured to the first step or plate 86 will at one point be stationary when the vertical slide bar 70 continues to move downwardly and by virtue of its being connected to the outer or last step plate 86 will cause the step platform assembly through the parallelogram linkage arrangement to move into the step or stair configuration, as shown in FIGS. 4 and 13.

In order to obtain the step or stair configuration, it is necessary to energize the stair formation mechanism 102 which when energized allows downward movement of the vertical slide bar 69 only to a given point and thereafter prevents this further downward movement while allowing continued downward movement of vertical slide bar 70. The stair formation mechanism which also may be defined as the steps solenoid mechanism is shown most clearly in FIGS. 5, 7, 8 and 9, and it generally includes a stop bar 103 movable between the position as shown in solid lines in FIG. 8 where it will prevent movement of the pick-up plate 75 of the slide bar 69 to a position shown in phantom and designated as 103*a* where it will allow downward movement of the pick-up plate 75. The stop bar 103 is secured to a shaft 104 carried by a bearing 105 that is in turn mounted on the channel member 67. The shaft 104 extends horizontally and perpendicular to the axis of the channel member 67. A spring 106 is carried on the shaft 104 and normally biases the stop bar 103 into its non-working position 103*a*. At the end of the shaft 104 opposite to where the stop bar is connected an actuating arm 107 is connected to the shaft and is in engagement with a plunger 108 of a solenoid 109 that is also mounted on the channel member 67. Energization of the solenoid 109 causes the plunger 108 to drive the arm 107 and shaft 104 to rotate the stop bar 103 into its stop position, as shown in solid lines, against stops 110 mounted on the channel member 67. In this position the extension 81 of the pick-up plate 75 will engage the stop bar 103 as illustrated in FIGS. 5 and 8, thereby preventing further downward movement of the vertical slide bar 69 as the ball nut 64 continues to descend. It may also be appreciated that when the solenoid 109 is not energized, the stop bar 103 will take the position as shown at 103 in FIG. 8 and allow the pick-up plate 75 to pass the step solenoid mechanism and move downwardly with the pick-up plate 76 of the slide bar 70 when it is desired to have the step platform assembly in platform configuration.

The apparatus of the invention is moved from retracted position within the car to extended position outside of the car for use by means of the horizontal actuator 44. Referring particularly to FIGS. 3, 4, 5, 10 and 11, the actuator includes a reversible electric motor 116 driving a gear box 117 which in turn drives a threaded shaft (not shown) but generally indicated by the numeral 118. A nut arrangement on the shaft is secured to a link 119 that in turn has pivotally connected to its outer end a drive arm 120. The drive arm is suitably connected to a shaft 121 carried in the bearings 122 that are supported on the channel member 67 and the vertical bracing bar 49. A double stranded sprocket 123 is keyed to the shaft 121 for rotation therewith and has trained thereover a double stranded chain 124 that is also trained over a double stranded sprocket 125 mounted in superposed relation to the sprocket 123. A sprocket 125 is keyed to a shaft 126 mounted in bearings 127 that are suitably supported between the channel 67 and the vertical bracing bar 49. Also secured to the shaft 126 for rotation therewith is an operator drive arm 130 having a roller 131 mounted on its free end which engages in a vertically arranged channel 132 that is mounted on the car frame. Accordingly, rotational movement of the lower sprocket 123 as accomplished by the horizontal actuator 44 will cause rotational movement of the sprocket 125 and like rotational movement of the drive arm 130. The upper end of the actuator 44 is pivotally connected at 133 to a bracket 134 carried by the channel member 67 of the slide bar assembly 40 as operation of the actuator 44 and driving of the drive arm 120 will cause slight swinging movement of the actuator relative to the slide bar assembly 40. The sprocket 123 has twice as many teeth as the sprocket 125 and therefore one degree of rotation of the sprocket 123 will provide two degrees of rotation of the sprocket 125.

Operation of the actuator 44 will cause movement of the operator drive arm 130 through slightly more than 180 degrees between the positions of the drive arm, as shown in solid lines and designated by the numeral 130 and in dotted lines and designated by the numeral **130*a* in FIG. 10. In each of these positions, as can be readily seen, the drive arm ultimately rests in a position that places the roller 131 slightly below the shaft 126 so that the actuator attains an overcenter locking position, both when the apparatus is retracted and in stored position within the car and when the apparatus is in extended and operable position outside of the car. The apparatus illustrated in FIGS. 3, 4, and 5 is in operating position outside of the car, and in this position the secondary or subframe assembly 26 is at its outward position relative to the main or primary frame or assembly 25**.

During retraction of the apparatus, the initial cycle of the horizontal actuator will cause the secondary frame assembly 26 to move relative to the primary frame assembly 25 until the secondary frame assembly bottoms at the inner side of the primary frame assembly after which continued operation of the horizontal frame actuator will cause the secondary frame assembly 26 and the primary frame assembly 25 to move together into retracted or stored position. Likewise, when the horizontal actuator 44 is operated to extend the apparatus, the initial part of the extension cycle will cause the secondary frame assembly 26 to move outwardly toward the outer edge of the primary frame assembly and bottom and then move together with the primary frame assembly to the outer operating position shown in FIGS. 3, 4 and 5.

It should be further appreciated that when the apparatus is being retracted within the car, the step platform assembly 27 will be in its highest position and in platform configuration so that it will clear the car floor as the apparatus moves into the car. When the apparatus is in completely retracted position, the step platform assembly will be allowed to descend to the car floor and rest on the car floor until it is to be used again. Thereafter, when the apparatus is to be extended, the step platform assembly 27 will be raised slightly off the car floor so that it will clear the car floor during its extension cycle.

In order to control the operation of the step platform assembly, suitable electrical circuitry having among other components a plurality of limit switches will be provided. With reference to FIG. 5, the location of the limit switches is schematically illustrated. It will be appreciated that some of the limit switches are actuable during the movement of the step platform assembly from the car floor when it is within the car, during the extension and retraction of the assembly between the in-car and out-car positions, and the operation of the step platform assembly for selectively obtaining adjustable height platform mode, stair mode or platform lift mode.

It will be further appreciated that operation of the step platform assembly is interlocked with operation of the car door and/or suitable gates to the entryway where the apparatus for passenger handling is located. When the door is open, the circuitry is conditioned so that certain push-button switches for initiating operations of the apparatus are operative.

Movement of the assembly from its seated position on the car floor within the car to its extended position out of the car and at car floor level is accomplished by initiating the "out" sequence. This will cause the step platform assembly to move upwardly a given distance so that it clears the floor and can then be extended outwardly of the car. The vertical motor for driving the vertical slide bar assembly is activated to raise the assembly so that it will clear the floor. As it moves upwardly and reaches a given position, limit switch LLS2 (151) limits the maximum upward movement of the assembly and conditions the circuitry to commence operation of the horizontal actuator to move the assembly outward of the car. Switch LLS2 is mounted at the upper end of the vertical slide bar assembly and actuable by one of the vertical slide bars 69 and 70. As the assembly moves outwardly, a sequence holding limit switch LLS10 (152) is actuated to shunt the limit switch LLS2 and insure circuit continuity when the assembly commences its downward movement. Switch LLS10 is mounted on the horizontal actuator and actuated by a cam (not shown) driven by shaft 126.

At the maximum outward position of the assembly, a main frame maximum outward movement limit switch LLS3 (153) is actuated to stop the outward movement of the assembly and to commence downward movement of the assembly to the car floor level. Switch LLS3 is likewise mounted on the horizontal actuator and cam actuated. When the assembly has moved downwardly to the car floor level, a car floor level descent stop limit switch LLS6 (154) is actuated to stop the verticle motor with the platform at car floor level. Switch LLS6 is mounted on the vertical slide bar assembly and actuable by one of the vertical slide bars.

If it is desired to move the platform downwardly either to another level or to the lowest level possible, the "down" sequence is commenced to activate the vertical drive motor and commence downward movement of the step platform assembly in the platform mode. If it is desired that the platform be lowered to its lowest point, the operator will continue to hold the control for purposes of continuing downward movement of the assembly until it reaches its maximum platform descent position, at which time it will actuate the maximum platform descent limit switch LLS8 (155) which halts the descent of the assembly. This switch is mounted on the vertical slide bar assembly in association with one of the slide bar channel assemblies and actuable by the respective vertical slide bar when the platform descends to the maximum lower level.

The "up" sequence of the assembly in the platform mode is achieved by initiating operation of the up control, and when the assembly reaches the car floor level, the upward movement limit switch LLS7 (156) is actuated to de-energize the vertical drive motor and to stop the upward motion of the step platform assembly at the car floor level. Switch LLS7 is mounted on the vertical slide bar assembly and actuable by one of the vertical slide bars.

Thereafter, if it is desired to bring the assembly back into the car, the "in" cycle is initiated by actuating the appropriate control so that the upward motion of the step platform assembly will resume until the maximum upward movement limit switch LLS2 is tripped to de-energize the vertical drive motor and activate the horizontal actuator to commence movement of the assembly into the car. During inward movement the sequence holding limit switch LLS10 is actuated to maintain circuit continuity when the limit switch LLS2 transfers during downward motion of the assembly. When the assembly reaches the maximum inward position, maximum inward movement limit switch LLS5 (157) will be tripped to de-energize the horizontal actuator and stop inward movement and condition the circuitry to activate the vertical drive motor to lower the assembly to the car floor. Switch LLS5 is mounted on the horizontal actuator and actuable by a cam (not shown) driven by shaft 126. As the assembly comes to rest on the car floor, the car floor limit switch LLS9 (158) will be actuated to de-energize the vertical drive motor.

When the assembly has been moved to its out-of-car position and in alignment with the car floor and it is desired to operate the step platform assembly in the steps mode, a "steps" control is operated which will cause downward movement of the step platform assembly and energization of the steps solenoid 109 to move the stop bar 103 into position to stop downward movement of the inboard slide bar 69 by blocking movement of the inboard pick-up plate 75. Continued downward movement of the assembly then allows only the outboard slide bar to descend with the ball nut 64 and the consequent formation of the stairs as the steps open up. Operation of the steps solenoid actuates the steps solenoid limit switch LLS11 (159) to indicate the assembly is in the stair mode. Switch LLS11 is located on the vertical slide bar assembly and actuable by the steps solenoid mechanism. It will be appreciated that the stair mode cycle can be initiated while the assembly is in the car and resting on the car floor, after which it will move outward of the car as previously described. Then as the assembly moves downwardly the step solenoid will stop the top step at the car position, one step below the car floor. Thereafter, continued downward movement of the assembly causes the parallelogram linkage of the assembly to open the steps. When the lowest step is at the maximum descent position, maximum descent limit switch LLS4 (160) is tripped to stop further downward movement by de-energizing the vertical drive motor. Switch LLS4 is mounted on the outboard slide bar and channel assembly and actuable by the outboard slide bar.

Also downward movement of the assembly during the formation of the stairs mode will actuate a steps solenoid limit switch LLS1 (161) which de-energizes the steps solenoid 109 at a time when the pick-up plate 75 is seated on the stop bar 103 and will thereafter mechanically hold it in place. Switch LLS1 is mounted on the outboard slide bar and channel assembly and actuable by the respective slide bar when the lowest step has reached the lowermost point or at any time after the inboard pick-up plate seats on the solenoid stop bar.

Thereafter, when it is desired to close the steps and reform a platform and move the assembly back into the car, a suitable control is actuated to cause outward movement of the vertical drive actuator which will fold the steps and reform a platform and continue to move the platform upwardly until the limit switch LLS2 is actuated upon the assembly reaching its maximum upward position. The vertical drive mechanism is then de-energized and the horizontal actuator is activated to drive the assembly back into the car until it reaches its maximum inward position, at which time limit switch LLS5 will be tripped to de-energize the horizontal actuator and activate the vertical actuator to lower the assembly to the car floor. The car floor limit switch LLS9 wil be tripped when the assembly seats on the floor to de-energize the vertical actuator.

A mechanical separation limit switch MSL (162) mounted on the vertical drive components detects if the inboard pick-up plate 75 separates from the outboard pick-up plate 76 during lifting or lowering operation of the step platform assembly in the platform mode and, if such occurs, causes the vertical drive assembly to immediately stop. Likewise, a mechanical separation switch MSS (163) detects separation between the outboard pick-up plate 76 and the ball nut 64 during movement of the step platform assembly into and out of the stair mode and, if such occurs, causes the immediate de-energization of the vertical drive assembly.

Step treadle switches are provided on each of the steps which, if actuated during movement of the step platform assembly into or out of the stair mode, will immediately cause stoppage of the assembly. Similarly, a sensitive edge switch mounted on the leading step of the step platform assembly will cause the assembly to immediately stop if it is actuated during the time that the step platform assembly is moving into or out of the car or the platform mode is moving between its upper or lower position outside of the car. When an obstacle engaging the assembly and activating any of the treadle switches or the sensitive edge switch is removed, the assembly will continue to move to its next position.

From the foregoing, it can be appreciated that the present invention provides a unique step platform assembly for use in railway cars which can take a step or platform configuration and which includes the necessary safety features such that it is safe for use by passengers during ingress and egress of the car.

It will be understood that modifications and variations may be effected without departing from the scope of the novel concepts of the present invention, but it is understood that this application is to be limited only by the scope of the appended claims.

The invention is hereby claimed as follows:

1. Passenger handling apparatus for a railway car to provide at an opening adjustable height platform, stair, or ground-to-car floor platform lift modes, said apparatus including a vertical frame means extending generally perpendicular to the longitudinal axis of the car and a step platform assembly supported by said frame means, means mounting the frame means on the car such that said frame means and assembly is movable between a stored position within the car through the opening to a position outside the car, first drive means for driving the frame means and assembly between the stored position and the position outside the car, said step platform assembly including a plurality of steps selectively movable between platform and stair configurations when the frame means and assembly are in the position outside the car, said steps being interconnected by a parallelogram linkage, means interconnecting the frame means and step platform assembly such that the steps can move between platform and stair configurations, second drive means coacting with the interconnecting means for selectively moving said assembly to provide the desired mode, and said interconnecting means including first and second vertical support bars movably driven by said second drive means and cantileverly supporting said step platform assembly, wherein relative movement therebetween will cause the steps to move between the platform and stair configurations and simultaneous movement thereof will cause vertical movement of said step platform assembly.

2. The apparatus of claim 1, wherein track means are provided on the frame means for slidably receiving said support bars.

3. The apparatus of claim 2, wherein said second drive means includes a vertically arranged externally threaded shaft rotatably mounted on said frame means, first and second pick-up plates along said shaft and respectively connected to said first and second support bars, nut means vertically driven along said threaded shaft to move said plates up and down, and means for selectively blocking downward movement of one of said pick-up plates when driving the apparatus to the stair mode.

4. The apparatus of claim 2, wherein said second drive means further includes a reversible motor drivingly connected to said threaded shaft.

5. The apparatus of claim 1, wherein one of said support bars engages the first of said plurality of steps and the other of said support bars engages the last of said plurality of steps.

6. The apparatus of claim 1, wherein said frame means includes a main frame slidably supported by said car and a subframe slidably supported by the main frame, and said first drive means includes an operator having a drive arm wherein said operator and drive arm is connected between said car and the subframe.

7. Passenger handling apparatus for a railway car to provide at an opening adjustable height platform, stair, or ground-to-car floor platform lift modes, said apparatus including a vertical frame means extending generally perpendicular to the longitudinal axis of the car and a step platform assembly supported by said frame means, said frame means including a main frame slidably supported by said car and a subframe slidably supported by the main frame, means mounting the frame means on the car such that said frame means and assembly is movable between a stored position within the car through the opening to a position outside the car, first drive means for driving the frame means and assembly between the stored position and the position outside the car, said first drive means including an operator having a drive arm wherein said operator and drive arm is connected between said car and the subframe, said step platform assembly including a plurality of steps selectively movable between platform and stair configurations when the frame means and assembly are in the position outside the car, said steps being interconnected by a parallelogram linkage, means interconnecting the frame means and step platform assembly such that the steps can move between platform and stair configurations, second drive means coacting with the interconnecting means for selectively moving said assembly to provide the desired mode, and said interconnecting means including first and second vertical support bars carried by the subframe and movably driven by said second drive means, wherein relative movement therebetween will cause the steps to move between the platform and stair configurations and simultaneous movement thereof will cause vertical movement of said step platform assembly.

8. The apparatus of claim 7, wherein track means are provided on the subframe for slidably receiving said support bars.

9. The apparatus of claim 8, wherein said second drive means includes a vertically arranged externally threaded shaft rotatably mounted on said subframe, first and second support bar drive arms respectively connected to said first and second support bars, nut drive means vertically driven along said shaft to move said drive arms up and down, and means for selectively blocking one of said drive arms when driving the apparatus to the stair mode.

10. The apparatus of claim 9, wherein one of said support bars engages the first of said plurality of steps and the other of said support bars engages the last of said plurality of steps.

11. The apparatus of claim 10, wherein said second drive means further includes a reversible motor drivingly connected to said threaded shaft.

12. Passenger handling apparatus for a railway car to provide at an opening adjustable height platform, step entry, or ground-to-car floor platform lift modes, said apparatus being extendable from and retractable into the opening and including a vertical frame extending generally perpendicular to the longitudinal axis of the car and slidable horizontally between a first position within the car to a second position projecting from the car, first drive means for driving the frame between said first and second positions, and a step platform assembly cantileverly supported on said frame including a series of steps interconnected by parallelogram linkage to be selectively movable between platform and stair configurations, first and second vertical support bars connected at their lower ends to the step platform assembly such that relative vertical movement between said bars will cause the steps to move between the platform and stair configurations, a vertically arranged externally threaded shaft rotatably mounted on said frame, guide means on said frame for slidably receiving said support bars, second drive means for driving said threaded shaft in either direction, a driven member received on and movable along said threaded shaft during rotation thereof, pick-up plates connected to the support bars and movable along said shaft with said driven member, means for selectively stopping movement of one of said plates, whereby selective operation of said shaft and said selective stopping means produces selective vertical movement to at least one of said support bars and provides the desired mode for the step platform assembly.

* * * * *